US008216048B2

(12) United States Patent
Cowan et al.

(10) Patent No.: US 8,216,048 B2
(45) Date of Patent: Jul. 10, 2012

(54) GAMING APPARATUS

(75) Inventors: Stephen Cowan, New South Wales (AU); Dean Wright, New South Wales (AU)

(73) Assignee: Paltronics Australasia Pty Limited, New South Wales (AU)

( * ) Notice: Subject to any disclaimer, the term of this patent is extended or adjusted under 35 U.S.C. 154(b) by 526 days.

(21) Appl. No.: 11/575,948

(22) PCT Filed: Sep. 23, 2005

(86) PCT No.: PCT/AU2005/001473

§ 371 (c)(1), (2), (4) Date: Mar. 23, 2007

(87) PCT Pub. No.: WO2006/032112

PCT Pub. Date: Mar. 30, 2006

(65) Prior Publication Data

US 2007/0235933 A1 Oct. 11, 2007

(30) Foreign Application Priority Data

Sep. 23, 2004 (AU) ..... 2004905519

(51) Int. Cl.
*A63F 9/24* (2006.01)

(52) U.S. Cl. ..... 463/18; 463/16; 463/17; 463/19; 463/20; 463/25; 463/42

(58) Field of Classification Search ..... 463/16–20, 463/25–27, 42
See application file for complete search history.

(56) References Cited

U.S. PATENT DOCUMENTS 6,146,273 A * 11/2000 Olsen ..... 463/27
6,238,288 B1 * 5/2001 Walker et al. ..... 463/26
6,319,122 B1 * 11/2001 Packes et al. ..... 463/16
6,375,567 B1 * 4/2002 Acres ..... 463/25
6,485,367 B1 * 11/2002 Joshi ..... 463/13
6,599,186 B1 * 7/2003 Walker et al. ..... 463/17
6,695,700 B2 * 2/2004 Walker et al. ..... 463/26

(Continued)

FOREIGN PATENT DOCUMENTS

WO WO 02/099760 A2 12/2002

(Continued)

OTHER PUBLICATIONS

Australian Patent Office, International Search Report. International Application No. PCT/AU2005/001473, filed on Sep. 23, 2005. Applicant, Paltronics Australasia Pty Limited et al. Oct. 17, 2005. (4 pages).

(Continued)

*Primary Examiner* — Peter DungBa Vo
*Assistant Examiner* — Steve Rowland
(74) *Attorney, Agent, or Firm* — Sterne, Kessler, Goldstein & Fox P.L.L.C.

(57) ABSTRACT

Gaming apparatus including a plurality of gaming machines (2) for providing respective players with a respective primary game and for providing primary game information to a gaming server (11) in communication with each of the gaming machines. The gaming server is responsive to the primary game information for providing a secondary game in which prizes are allocated to gaming machines selected from among the plurality of gaming machines, the probability of a prize being allocated to a gaming machine being dependent upon gaming activity at that gaming machine. The value of any prize allocated to a gaming machine is also dependent upon gaming activity at that gaming machine.

69 Claims, 5 Drawing Sheets

U.S. PATENT DOCUMENTS

| | | | | |
|---|---|---|---|---|
| 6,712,695 | B2 | 3/2004 | Mothwurf et al. | |
| 6,739,973 | B1 * | 5/2004 | Lucchesi et al. | 463/35 |
| 6,764,397 | B1 * | 7/2004 | Robb | 463/23 |
| 6,852,027 | B2 * | 2/2005 | Kaminkow et al. | 463/16 |
| 6,966,834 | B1 * | 11/2005 | Johnson | 463/25 |
| 7,371,166 | B1 * | 5/2008 | Webb et al. | 463/12 |
| 2002/0093136 | A1 * | 7/2002 | Moody | 273/139 |
| 2002/0177483 | A1 | 11/2002 | Cannon | |
| 2003/0100361 | A1 | 5/2003 | Sharpless et al. | |
| 2003/0104853 | A1 | 6/2003 | Tessmer et al. | |
| 2003/0157979 | A1 * | 8/2003 | Cannon et al. | 463/16 |
| 2005/0143166 | A1 * | 6/2005 | Walker et al. | 463/25 |
| 2006/0019734 | A1 * | 1/2006 | Roemer | 463/16 |

FOREIGN PATENT DOCUMENTS

| | | | |
|---|---|---|---|
| WO | WO 03/045520 | A1 | 6/2003 |

OTHER PUBLICATIONS

Australian Patent Office. PCT Written Opinion of the International Searching Authority. International Application No. PCT/AU2005/001473, filed on Sep. 23, 2005. Applicant, Paltronics Australasia Pty Limited et al. Oct. 26, 2005. (4 pages).

* cited by examiner

| Variables | Value |
|---|---|
| Jackpot Percentage | 1.50% |
| Machine attached to Link | 500 |
| Average Turnover per Month | $60,000.00 |
| Average Days Open | 16 |
| Average Minutes Open | 960 |
| Total Turnover per Month | $30,000,000.00 |
| Jackpot Pool per Month | $450,000.00 |
| Jackpot Pool per Day | $14,754.10 |
| Jackpot Pool per Minute | $15.37 |
| Number of Games per Hour | 6 |
| Division 1 Prize % of Pool | 0.00% |
| Division 2 Prize % of Pool | 25.00% |
| Division 3 Prize % of Pool | 25.00% |
| Division 4 Prize % of Pool | 50.00% |

| | |
|---|---|
| Number of Numbers Selected | 4 |
| Number of Numbers Given | 4 |
| Total Numbers in Game | 30 |

| | | Per Game | Per Hour | Per Day Av | Per Month Av |
|---|---|---|---|---|---|
| Division 1 Pool Value | 0.00% | $0.00 | $0.00 | $0.00 | $0.00 |
| Division 2 Pool Value | 50.00% | $76.84 | $461.07 | $7,377.05 | $225,000.00 |
| Division 3 Pool Value | 25.00% | $38.42 | $230.53 | $3,688.52 | $112,500.00 |
| Division 4 Pool Value | 25.00% | $38.42 | $230.53 | $3,688.52 | $112,500.00 |
| | | Per Game | Per Hour | Per Day | Per Month |
| Division 1 | Games | 0 | 0 | 0 | 0 |
| Division 2 | Games | 1 | 6 | 96 | 2928 |
| Division 3 | Games | 1 | 6 | 96 | 2928 |
| Division 4 | Games | 1 | 6 | 96 | 2928 |

| | | Per Game | Per Hour | Per Day | Per Month | Average Prize |
|---|---|---|---|---|---|---|
| Division 1 | Chances | | 0.00 | 0.00 | 0.00 | $0.00 |
| Division 2 | Chances | 0.57 | 3.45 | 55.17 | 1682.76 | $133.71 |
| Division 3 | Chances | 0.02 | 0.12 | 1.97 | 60.10 | $1,871.93 |
| Division 4 | Chances | 0.00 | 0.00 | 0.07 | 2.23 | $50,542.01 |

FIG. 4

GAMING APPARATUS

CROSS-REFERENCE TO RELATED APPLICATIONS

This application is a U.S. National Stage entry of co-pending International Patent Application No. PCT/AU2005/001473, filed on Sep. 23, 2005 by COWAN, Stephen et al. entitled GAMING APPARATUS, the entire contents of which are incorporated by reference, and to which priority is claimed under 35 U.S.C. §371. As in the parent International Patent Application No. PCT/AU2005/001473, priority is also claimed to co-pending Australia Application No. 2004905519 filed on Sep. 23, 2004, the entire contents of which are incorporated by reference, and to which priority is claimed under 35 U.S.C. §119.

FIELD OF THE INVENTION

The present invention relates to gaming and in particular to gaming apparatus, and gaming machines, systems and methods.

The invention has been developed primarily for allowing a plurality of players to take part in a linked or common jackpot game and will be described hereinafter with reference to this application. However, it will be appreciated that the invention is not limited to this particular field of use.

BACKGROUND

Any discussion of the prior art throughout the specification should in no way be considered as an admission that such prior art is widely known or forms part of common general knowledge in the field.

Known standalone jackpot games include, for example, those games operated under the Lotto™, Pools™, Keno™, and Bingo™ marks. These types of games often offer large jackpots with the player being able to select their own numbers. These types of games are also popular for group environments, as they allow the players to socialize while playing the game.

It is also known to implement a common jackpot game for a plurality of gaming machines. That is, the player for any one of the machines participates in a first game of chance provided by the corresponding gaming machine, and a second game of chance that is common to all players. These common games typically involve a centrally displayed total prize value being incremented in response to the players playing each of the first games. Once the total prize value reaches a threshold that is not disclosed to the players, that prize value is awarded to the player who, by playing the respective first game, resulted in the threshold being reached.

However these types of games also suffer the disadvantage that users have to wait a relatively long time for the game to be drawn. A further disadvantage is that the user generally has to wait until the current game is complete before being able to take part in a further game.

SUMMARY OF THE INVENTION

It is an object of the present invention to overcome or ameliorate at least one of the disadvantages of the prior art, or to provide a useful alternative.

According to a first aspect of the invention, gaming apparatus is provided including:

a plurality of gaming machines for providing respective players with a respective primary game and for providing primary game information to a gaming server;

a gaming server in communication with each of the gaming machines and responsive to the primary game information for providing a secondary game in which prizes are allocated to gaming machines selected from among the plurality of gaming machines, the probability of a prize being allocated to a gaming machine being dependent upon gaming activity at that gaming machine.

Preferably, the secondary game has a plurality of prizes levels, the probability of the various prize levels being allocated to a gaming machine being dependent upon gaming activity at that machine.

Preferably, for each prize level, there is a gaming activity threshold below which the probability of that prize being allocated is zero.

Preferably, a higher prize level has a higher gaming activity threshold than a lower prize level.

Preferably, the gaming server is adapted to allocate prizes periodically. Additionally or alternatively, the gaming server is preferably adapted to allocate prizes at a time determined by gaming activity at at least one of the gaming machines. Preferably, for each respective gaming machine, the level of the prize to be allocated, if any, is determined in dependence upon a number of symbols allocated to the gaming machine, said symbols being selected from a predetermined set of symbols. Preferably, the symbols are allocated to the respective gaming machines randomly. Alternatively, however, the symbols may be allocated to the respective gaming machines in dependence upon selections by the player of the machine.

Preferably, the number of symbols allocated to each respective gaming machine is determined in dependence upon gaming activity at the gaming machine.

Preferably, higher levels of gaming at a respective gaming machine result in a larger number of symbols being allocated to the gaming machine.

Preferably, prior to allocation of prizes, the gaming server selects a plurality of symbols from the predetermined set of symbols, and wherein prizes are allocated to respective gaming machines in dependence upon identity between symbols allocated to the gaming machine and symbols selected by the gaming server.

Preferably, the prize level allocated to a respective gaming machine depends upon the number of symbols allocated to the gaming machine which match symbols selected by the gaming server.

Preferably, the number of symbols allocated to each respective gaming machine is less than or equal to a predetermined maximum number.

Preferably, the predetermined maximum number is less than the number of symbols selected by the gaming server.

A second aspect of the invention provides a method of operating gaming apparatus including the steps of:

providing a plurality players with a respective primary at respective gaming machines which and provide primary game information to a gaming server;

at a gaming server, in communication with each of the gaming machines and responsive to the primary game information, providing a secondary game in which prizes are allocated to gaming machines selected from among the plurality of gaming machines, the probability of a prize being allocated to a gaming machine being dependent upon gaming activity at that gaming machine.

Preferably, the secondary game has a plurality of prizes levels, the probability of the various prize levels being allocated to a gaming machine being dependent upon gaming activity at that machine.

Preferably, for each prize level, there is a gaming activity threshold below which the probability of that prize being allocated is zero.

Preferably, a higher prize level has a higher gaming activity threshold than a lower prize level. Preferably, the prizes are allocated periodically. Additionally or alternatively, the prizes are preferably allocated at a time determined by gaming activity at at least one of the gaming machines.

Preferably, for each respective gaming machine, the level of the prize to be allocated, if any, is determined in dependence upon a number of symbols allocated to the gaming machine, said symbols being selected from a predetermined set of symbols. Preferably, the symbols are allocated to the respective gaming machines randomly. Alternatively, however, the symbols may be allocated to the respective gaming machines in dependence upon selections by the player of the machine.

Preferably, the number of symbols allocated to each respective gaming machine is determined in dependence upon gaming activity at the gaming machine.

Preferably, higher levels of gaming at a respective gaming machine result in a larger number of symbols being allocated to the gaming machine.

Preferably, the method further includes the steps of, prior to allocation of prizes, at the gaming server selecting a plurality of symbols from the predetermined set of symbols, and allocating prizes to respective gaming machines in dependence upon identity between symbols allocated to the gaming machine and symbols selected by the gaming server.

Preferably, the prize level allocated to a respective gaming machine depends upon the number of symbols allocated to the gaming machine which match symbols selected by the gaming server.

Preferably, the number of symbols allocated to each respective gaming machine is less than or equal to a predetermined maximum number.

Preferably, the predetermined maximum number is less than the number of symbols selected by the gaming server.

According to a further aspect of the present invention there is provided a gaming machine for use by a player, the machine including:

a first interface that is responsive to the player to initiate a first game that provides a finite chance of a first prize being awarded to the player; and a second interface that is responsive to the first game for providing gaming information to a gaming controller and for receiving a control signal from the controller to allow the player to partake in a second game that provides a finite chance of a second prize being awarded to the player.

Preferably, the first game has an expected duration and the second game has a predetermined duration and wherein the predetermined duration is greater than the expected duration.

Preferably also, the predetermined duration is greater than a sequence of consecutive first games. Preferably, the predetermined duration is many times greater than the sequence of consecutive first games.

Preferably, the gaming controller includes a credit receiver for receiving credit from the player to wager on the first game. Preferably also, at least a portion of the credit is wagered on the second game.

Preferably, the first prize is selected from a pool of available prizes. Preferably also, the first interface is responsive to the player to respectively initiate a plurality of first games each of which provides a finite chance of the first prize being awarded to the player.

Preferably, the credit receiver includes an accumulator to provide a credit signal that is indicative of the wagers on the first games, the machine being responsive to the credit signal for deriving the gaming information and the controller being responsive to the gaming information for selectively providing the control signal.

Preferably also, the credit signal is indicative of the timing and quantum of the wagers.

In some embodiments the machine includes a timer for defining a predetermined past period, wherein the machine is responsive to the credit signal and the predetermined past period when deriving the gaming information.

Preferably, the controller includes a prize server for determining a prize value for the second prize and for selectively including data indicative of the prize value in the control signal. Preferably also, the prize server selectively includes the data in the control signal if the player has been awarded the second prize.

Preferably, the prize server is responsive to the gaming information for determining the prize value. More preferably, the gaming information includes data indicative of the prize value. In some embodiments the gaming machine includes a display unit that is responsive to the gaming information for displaying the prize value. Preferably, the display unit includes an LED screen.

In some embodiments the second game includes:

the gaming controller allocating a set of symbols to each of the players participating in the second game, where the symbols in each set are a sub-set of the available symbols available for allocation; and the display unit displaying to the players at predetermined intervals a selected symbol.

Preferably, the sets of symbols are each unique for each given second game. More preferably, the second interface allows the player to select the symbols in the set.

Preferably, a plurality of gaming machines as described above is located in a gaming room. Preferably, the gaming room includes a prize display capable of communicating with the prize server for displaying the prize value of the second prize.

According to a further aspect of the present invention there is provided a method of gaming including:

being responsive to a player for initiating a first game that provides a finite chance of a first prize being awarded to the player;

being responsive to the first game for providing gaming information to a gaming controller; and receiving a control signal from the controller to allow the player to partake in a second game that provides a finite chance of a second prize being awarded to the player.

According to a further aspect of the present invention there is provided a gaming system including:

a gaming machine having a first interface that is responsive to the player to initiate a first game that provides a finite chance of a first prize being awarded to the player, and a second interface that is responsive to the first game for providing gaming information; and a gaming controller for generating a control signal that is provided to the second interface for allowing the player to partake in a second game that provides a finite chance of a second prize being awarded to the player.

According to a further aspect of the present invention there is provided a method for gaming including:

providing a gaming machine having a first interface that is responsive to the player to initiate a first game that provides a finite chance of a first prize being awarded to the player and a second interface that is responsive to the first game for providing gaming information; and generating with a gaming controller a control signal that is provided to the second interface for allowing the player to partake in a second game that provides a finite chance of a second prize being awarded to the player.

According to further aspect of the present invention there is provided a gaming system including:

a primary gaming machine for providing a player with a first game, said primary gaming machine being connected to a communications link, a secondary gaming machine in communication with said gaming machine for providing said player with a second game; and a link controller connected to said communications link and being in communication with said secondary gaming machine for providing gaming information to said secondary gaming machine.

Preferably, the second game is selectively provided to the player by the link controller. Preferably also, the second game is selectively provided to the player based on a trigger event. In some embodiments, the trigger event is a function of time. In other embodiments, the trigger event is a function of an amount wagered by the player on the first game.

Preferably, the second game includes a plurality of playing levels. Preferably also, each playing level corresponds to a different prize. More preferably, during the course of the second game, the player progresses through the plurality of gaming levels.

In some embodiments, the primary gaming machine includes an interface card in communication with the secondary gaming machine for enabling communication between the primary gaming machine and the secondary gaming machine. Preferably, the interface card further enables communication between the secondary gaming machine and the link controller via the communications link. Preferably, the communication is in a proprietary protocol.

In some embodiments, the secondary gaming machine includes a keypad for allowing the player to input selections during the second game. Preferably, the secondary gaming machine includes a display for displaying the second game to the player. More preferably, the gaming system includes a display in communication with the link controller for displaying selected gaming information. Preferably, the link controller is programmable for providing a plurality of second games.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

BRIEF DESCRIPTION OF THE DRAWINGS

A preferred embodiment of the invention will now be described, by way of example only, with reference to the accompanying drawings in which:

FIG. 4 is a table showing calculations of a second game according to the invention.

DETAILED DESCRIPTION

Overview

Figure 1:
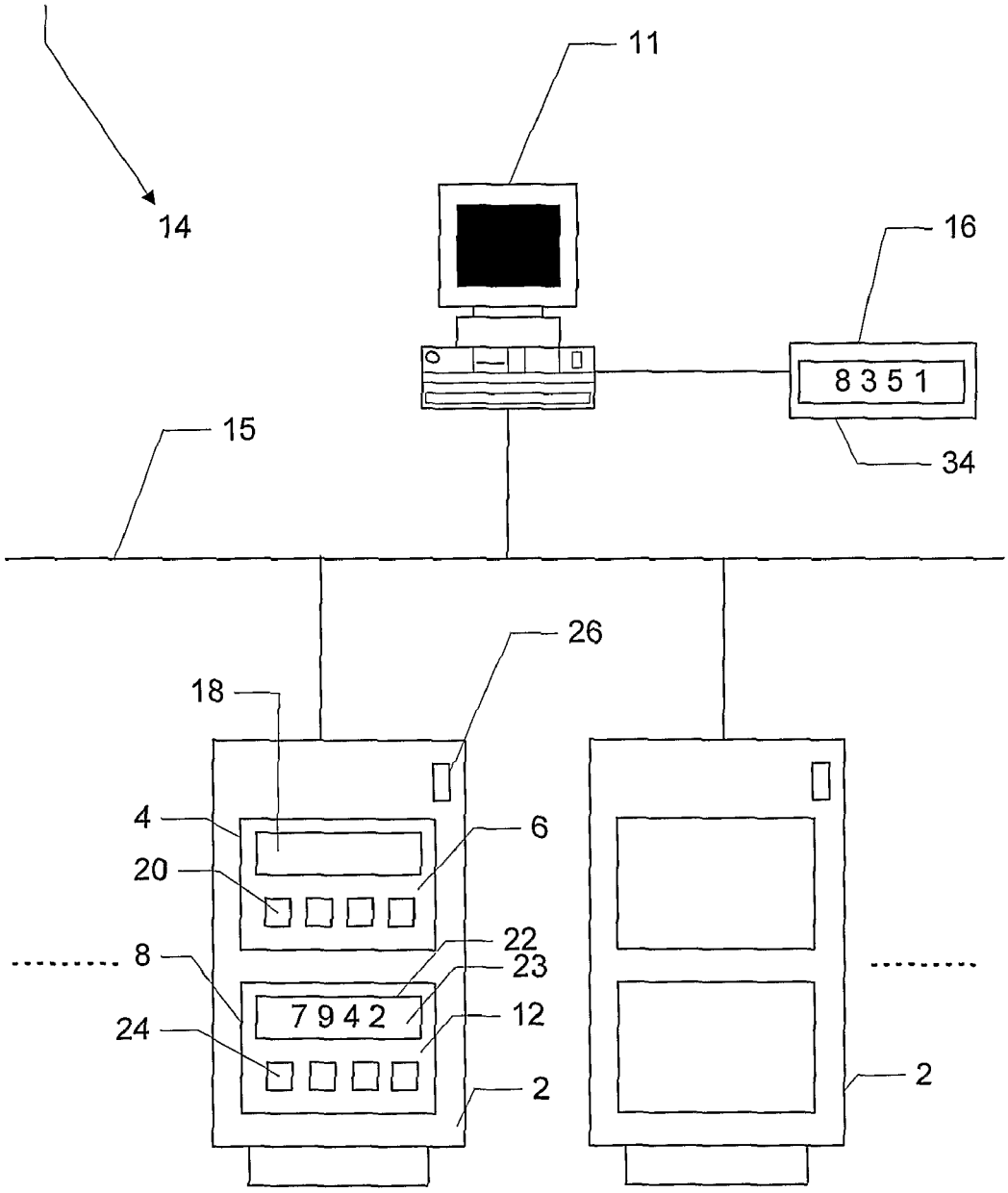
FIG. 1 is a schematic representation of gaming apparatus according to the invention.

In overview, FIG. 1 shows gaming apparatus including:

a plurality of gaming machines 2 for providing respective players with a respective primary game and for providing primary game information to a gaming server 4;

a gaming server 11 in communication with each of the gaming machines 2 and responsive to the primary game information for providing a secondary game in which prizes are allocated to gaming machines 2 selected from among the plurality of gaming machines, the probability of a prize being allocated to a gaming machine being dependent upon gaming activity at that gaming machine.

The secondary game has four prizes levels, for example $50, $100, $500, $1000. The probability of each of the prize levels being allocated to a particular gaming machine is dependent upon gaming activity at that machine. That is to say, higher levels of gaming activity at a gaming machine increases the probability of a prize being allocated to that machine. Furthermore, for each prize level, there is a gaming activity threshold below which the probability of that prize being allocated is zero.

The gaming activity threshold for each successive prize level is higher than that for the preceding prize level. Thus, up to a first prize level gaming activity threshold, the probability of winning any prize in the secondary game is zero. Between the first and second prize level gaming activity thresholds, the probability of winning $50 is non-zero, while the probability of winning any of the other prizes remains zero; between the second and third prize level gaming activity thresholds, the probability of winning $100 in the secondary game is non-zero, while the probability of winning any of the higher prizes remains zero; and so on.

In an example of a preferred embodiment, gaming activity at a particular gaming machine results in a secondary game symbol selected from a predetermined set of symbols being allocated to a gaming machine. The number of symbols allocated to each respective gaming machine is determined in dependence upon gaming activity at the gaming machine, with more symbols being allocated, up to a predetermined maximum, as a result of higher levels of gaming activity.

In various such embodiments, secondary game symbols are allocated as a result of: played credit at a gaming machine passing progressive thresholds; played credit at a gaming machine within successive periods being the highest or among the highest of all gaming machines in the apparatus; and so on.

In one class of such embodiments, the symbols are allocated to the respective gaming machines randomly. In an alternative class, symbol credits are allocated to the respective gaming machines, and the symbols themselves are selected by the player of the machines.

The level of the prize, if any, allocated to a particular machine is determined in dependence upon the number of symbols allocated to that gaming machine.

In one broad class of embodiments, the gaming server allocates prizes periodically. However, in other embodiments, the gaming server allocates prizes at a time determined by gaming activity at at least one of the gaming machines. In yet further embodiments, the allocation of prizes occurs both periodically, and additionally in response to gaming activity.

For example, in some embodiment, the allocation or prizes is triggered by a gaming machine or a predetermined number of gaming machines being allocated the maximum number of symbols, or in a predetermined overall number of symbols being allocated.

When allocation of prizes is to be effected, the gaming server selects a plurality of symbols from the predetermined set of symbols. The number of symbols selected by the gaming server is greater than the maximum number of symbols which may be allocated to the gaming machines. Prizes are allocated to respective gaming machines in dependence upon identity between symbols allocated to the gaming machine and symbols selected by the gaming server. In the present example, $50 is awarded to any gaming machine which has one allocated symbol matching one of the symbols selected by the gaming server; $100 is allocated to any machine having two matching symbols; $500 is allocated to any machine having three matching symbols; and $1000 is allocated to any machine having four matching symbols.

In various embodiments, the symbols may be numbers or graphic symbols. To vary the probability and expectation characteristics of the second game the following parameters may be varied:

- the prize levels;
- the criteria for allocation of symbols (for example higher or lower thresholds);
- the size of the predetermined set of symbols;
- the maximum number of symbols which may be allocated to the gaming machines;
- the number of symbols selected by the gaming server.

DETAILED EXAMPLES

Further examples will now be described in greater detail.

Referring to the drawings, the gaming machine 2 for use by a player (not shown) includes a first interface 4 that is responsive to the player to initiate a first game 6 that provides a finite chance of a first prize being awarded to the player. A second interface 8 is responsive to the first game 6 for providing gaming information to a gaming controller 10 and for receiving a control signal from the gaming controller. The control signal allows the player to partake in a second game 12 that provides a finite chance of a second prize being awarded to the player.

FIG. 1 shows a gaming system 14 that includes a plurality of gaming machines 2 in communication with a gaming server 11 via a network 15. The gaming server 11 is connected to a LED display unit 16.

The first interface 4 of each gaming machine 2 includes a first screen 18 for displaying the first game 6 that is offered by the gaming machine. The first interface 4 also includes and a set of first controls 20 through which the player inputs their choices during the first game.

The second interface 8 of each gaming machine 2 includes a second screen 22 for displaying the second game 12 that is offered by the gaming machine. The second interface 8 also includes a set of second controls 24 through which the player inputs their choices during the second game.

While in this embodiment, separate interfaces are used for each of the first and second games, some embodiments include only one interface which is used for both games.

Each gaming machine 2 also includes a credit receiver in the form of a payment port 26 to allow the user to enter gaming credit units for the game or games to be played. In this embodiment the payment port 26 accepts coins, although in other embodiments the payment port includes an electronic card reader. In some embodiments the payment port accepts tokens having a predetermined value.

In return for a player submitting a gaming credit unit or an equivalent suitable payment via the payment port 26, the gaming machine allows the player to play a first game of chance. The game may result in a first prize being awarded to the player. The likelihood of gaming machine 2 awarding a prize for a particular game play is determined by the design of the first game 6.

In this embodiment, the first game 6 is a pokies game having an expected duration of 1 second. As is known in the art, any prize awarded is drawn from a pool of available prizes and its value depends on the particular winning combination. In other embodiments, the first game 6 is any of one of a number of games as would be known to those skilled in the art, such as those operated under the Lotto™, Pools™, Keno™, and Bingo™ marks.

In addition to the first game, the player is able to participate in a second, linked game. While in the present embodiment the gaming machine 2 provides the first game 6 and some aspects of the second game 12, in some embodiments the gaming machine 2 provides the first game and the gaming server 11 provides the second game 12. As would be understood by those skilled in the art, having the second game 12 provided by the gaming controller 10 allows the functionality of the second game to be retrofitted to those types of gaming machines (not shown) that have been designed only to provide a single game. This minimizes the modifications needed to those particular types of gaming machines. In some embodiments, this is achieved by the provision adjacent each gaming machine of a respective secondary game module, having a user input device and display, which is in communication with both the respective gaming machine and the gaming server 11 via the network 15.

The second game 12 provides a finite chance of a second prize being awarded to the player. In this embodiment, the second game 12 is a numbers game in which the gaming controller 10 allocates a set of numbers 23 to the player. The set of numbers includes four numbers that are randomly drawn from a pool of thirty predetermined numbers. The allocated numbers are displayed on the second game interface display 22. At the conclusion of the second game 12, the gaming server 11 draws winning numbers from the pool of numbers and awards a second prize based upon matches between the set of numbers and the winning numbers 34.

As indicated above, it will be appreciated that the quantity of numbers in the pool of numbers and the quantity of numbers in the set of numbers can be varied to suit the desired games. In will also be understood that the second game 12 need not be a numbers game as described above, but can be one of any game of chance that would be know to those skilled in the art. In some embodiments, the second game 12 is chosen from those operated under the Lotto™, Pools™, Keno™, and Bingo™ marks. In alternative embodiments the second game 12 is roulette game or a similar casino wheel game and players are allocated numbers in which to participate in the game. In some other embodiments, the second game is blackjack, poker or another card game.

In some embodiments the first game 6 is predetermined while the second game 12 is selected by player from a predetermined pool of games. In other embodiments both the first game and the second game are varied and chosen by the player from a pool of available games.

In the present embodiment, the second game 12 has a predetermined duration of ten minutes after which the winning numbers are drawn by the gaming server 11 and the second game starts again. It will be appreciated that the predetermined duration of the second game is much larger than the expected duration of the first game 6 allowing the player to play a sequence of many first games for every second game that is played. In other embodiments different predetermined durations are used. In some embodiments the duration of the second game 12 is random.

In this embodiment, the second game 12 is not provided to the player until a predetermined condition is met. In this instance, the predetermined condition is that the amount of credit wagered on the first game 6 by the player must exceed the threshold value of $1, before the winning numbers are drawn. If the player does not achieve this they are not allocated any numbers and consequently the second game cannot be played. If the threshold is achieved then the set of numbers is provided to the player and the player participates in the numbers game. Once that particular second game is completed, the player must again achieve the threshold before being allowed to participate in the next numbers game.

In other embodiments the predetermined condition is modified. In some embodiments the condition is time based and involves the player having to play the first game 6 for a predetermined time. In other embodiments no predetermined condition exists and so long as sufficient credit is available, the player is allowed to play the second game.

In some embodiments, a portion of the credit wagered by the player on the first game 6 is allocated to the player to wager on the second game 12.

In some embodiments, the manner in which the set of numbers is provided to the player is varied and once a player meets the predetermined condition, they are allocated a single number. Another condition must then be met for the player to be allocated the next number and so on until the complete set of numbers has been allocated. As would be understood by those skilled in the art, the more numbers allocated to the player, the larger the potential value of the second prize that may be awarded to the player.

In some embodiments, the second game 12 includes the gaming controller 10 allocating a unique set of symbols to each of the players participating in the second game, where the symbols in each set are a sub-set of the available symbols available for allocation. In some embodiments, the second controls 24 are adapted to allow the player to select the symbols in the set. In other embodiments, the second controls 24 are adapted to allow the player to select the set of numbers 23.

As can be seen in FIG. 1, the second screen 22 displays the set of numbers 23 that have been allocated to the player. In this example, the set of numbers is "7 9 4 2". In some embodiments the second screen 22 displays other features of the second games such as a roulette wheel, a deck of playing cards or other icons associated with the particular second game that is being played.

Figure 2:
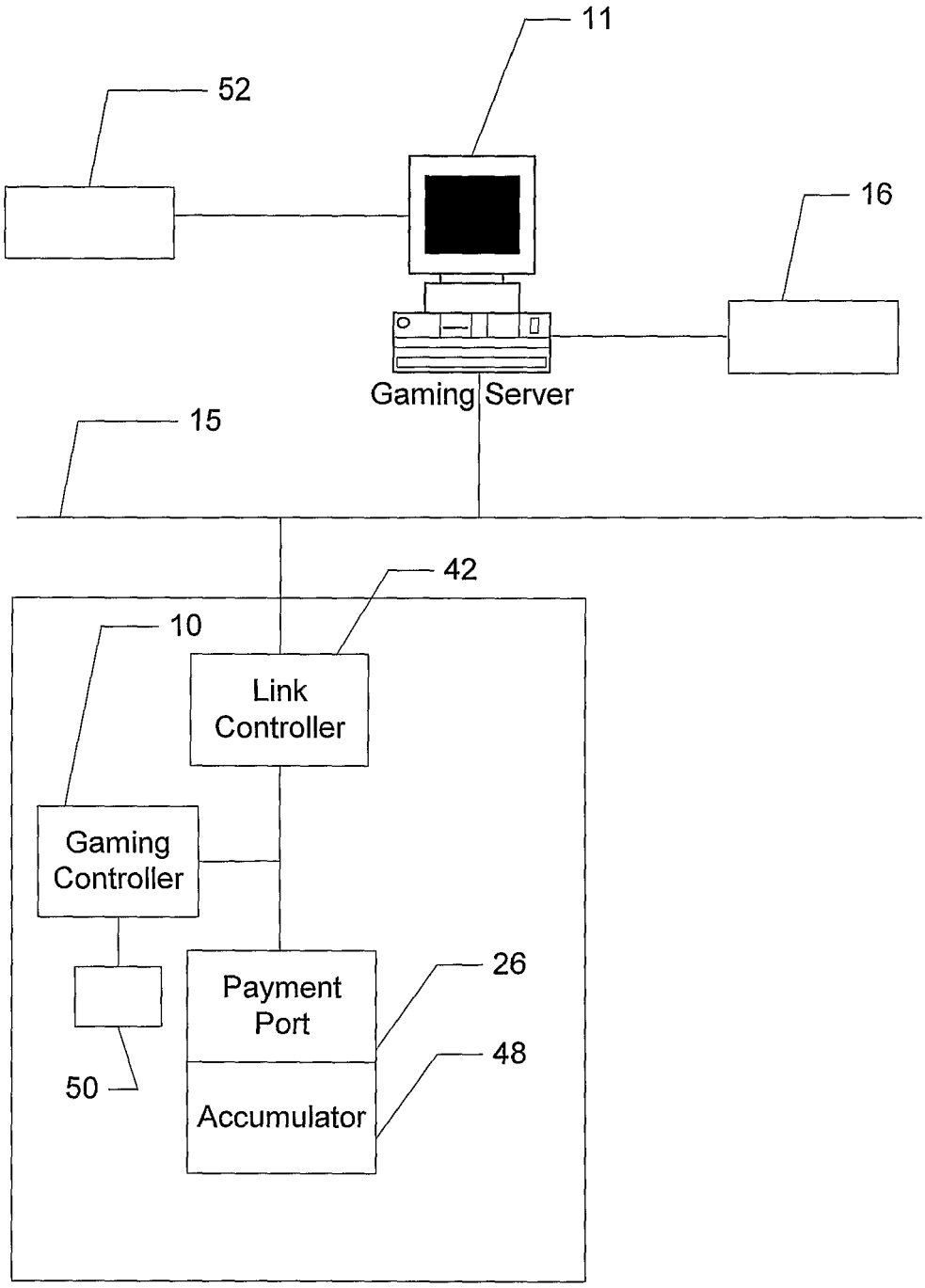
FIG. 2 is a schematic representation of some of the hardware associated with each of the gaming apparatus of FIG. 1.

FIG. 2 illustrates some of the hardware of one of the gaming machines 2 and the gaming server 11. A link controller 42 connects the gaming machine 2 to the network 15. The link controller is in communication with the gaming controller 10. The link controller 42 is also in communication with the payment port 26. The payment port includes an accumulator 48 that provides a credit signal that is indicative of the wagers on the first game 6. The gaming controller 10 is responsive to the credit signal for deriving the gaming information and for selectively providing a control signal to the second interface 8. That is, the second game 12 is only available to the player when the predetermined conditions are met. At that time, the controller 10 provides the control signal and the second game 12 can be played.

The credit signal is indicative of the timing and quantum of the wagers by the player on the first game 6. The gaming machine 2 also includes a timer 50 for defining a predetermined past period, wherein the gaming machine is responsive to the credit signal and the predetermined past period when deriving the gaming information.

The gaming controller 10 is in communication with the gaming server 11 for determining a prize value for the second prize. The gaming server 11 includes data indicative of the prize value to each gaming machine in a respective control signal to the respective gaming machines if the player has been awarded a second game prize. The gaming server 11 or a prize server 52 in communication with the gaming server 11 is responsive to information from the gaming machines for determining the prize value.

The gaming server 11 is in communication with the LED display unit 16 for displaying data relating to the second game, for example the size of a prize pot, the value of the maximum prize which may be awarded in the second game, and the winning numbers 34 or the time remaining until winning numbers will next be drawn.

Figure 3:
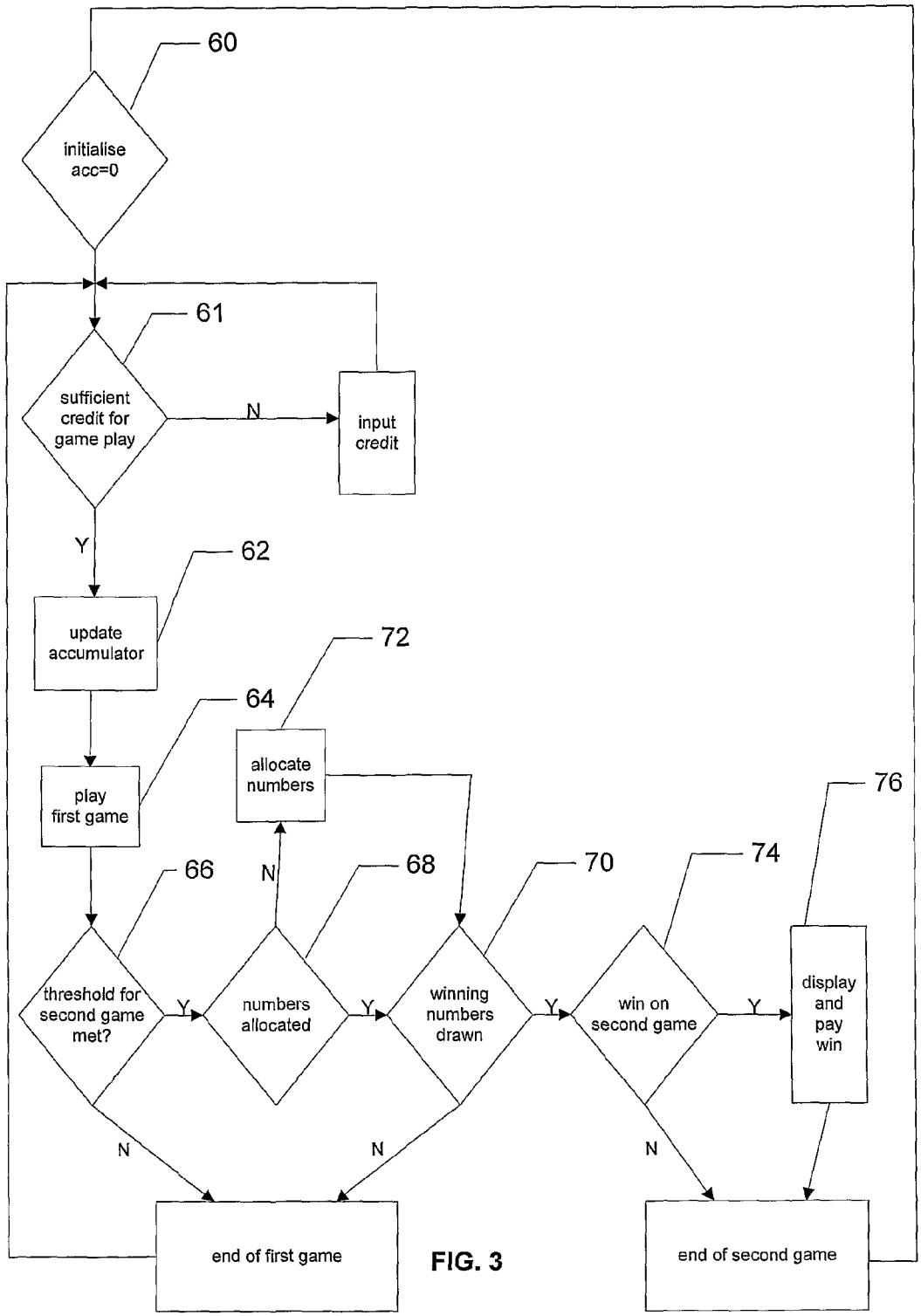
FIG. 3 is a flow chart showing steps performed by the gaming machines of the apparatus shown in FIG. 1.

The operating process during one iteration of the second game of an example of one of the gaming machines 2 will now be described with reference to the flow chart in FIG. 3. At the first step 60, an accumulator of the gaming machine is set to zero. The process holds at step 61 until the player inputs some monetary value into the payment port 26 to play the pokies game at which point processing moves to step 62.

At step 62 the accumulator is updated with the monetary value inputted into the payment port 26. That is, the amount wagered on the pokies game 28 is added to a value stored in the accumulator 48. Processing then proceeds to step 64.

At step 64, a pokies game 28 is played and a first prize may be awarded depending on the outcome of the game. The processes of the pokies game are known and will not be described here. Once the first game is completed, processing proceeds to step 66.

In step 66, the value stored in the accumulator 48 is compared to predetermined threshold for allowing the player to play the second game 12. In this embodiment, the predetermined condition is that the amount of credit wagered on the first game 6 by the player must exceed $1. Therefore the value of the number stored in the accumulator must be greater than $1 to allow the player to play the numbers game 30. If the threshold is not met, processing returns to step 61. If the threshold is met, processing proceeds to step 68.

At step 68 the gaming machine 2 checks whether a set of numbers (or the maximum number of numbers) has already been allocated to player to play the numbers game. If the player has already been allocated a set of numbers (or the maximum number of numbers) processing proceeds to step 70. Otherwise, processing proceeds to step 72 where the player is allocated a set of numbers 32.

In step 70, the gaming machine checks whether that particular numbers game has had its winning numbers drawn. If the winning numbers have not been drawn yet, processing returns to step 61. If the winning numbers have been drawn, processing proceeds to step 74.

In step 74, the set of numbers that has been allocated to the player is compared to the winning numbers 34. Depending on the matches, if any, between the set of numbers and the winning number 34, a prize may be awarded. If a prize is to be awarded, processing proceeds to step 76.

In step 76, a win is displayed to the player and the appropriate prize is awarded. Processing then returns to step 60 for the next iteration of the numbers game.

Numbers Game Example 1

FIG. 4 shows calculations based on an embodiment of the invention where all players automatically participate in the second game 12. The second game is a numbers game similar to game and the calculations are based upon 500 gaming machines 2 being linked. The gaming controller 10 allocates the numbers to the players.

Numbers Game Example 2

Another embodiment of the invention allows the player to be more interactive. In this game, the player plays the first game 6 provided by the gaming machine 2. A percentage of the amount wagered of the first game 6 is allocated to the player in the form of credit to play the numbers game 30. The player decides when to play the second game by actuating the second controls 24, confirming their participation in the second game and allocating an amount of credit to wager on the second game. The player chooses whether to select a set of numbers or be allocated a set of numbers by the controller 10 through the second controls 24. Depending upon the amount wagered on the numbers game 30, fixed prizes are paid as a multiplication factor of the amount wagered.

For example,

Division 1 Fixed Prize of $25 for a $1 bet

Division 2 Fixed Prize of $750 for a $1 bet

Division 3 Fixed Prize of $25,000 for a $ bet.

As described previously, in some embodiments the player must achieve a predetermined condition such as having wagered at least $1 on the first game 6 before being able to play the numbers game 30.

Figure 5:
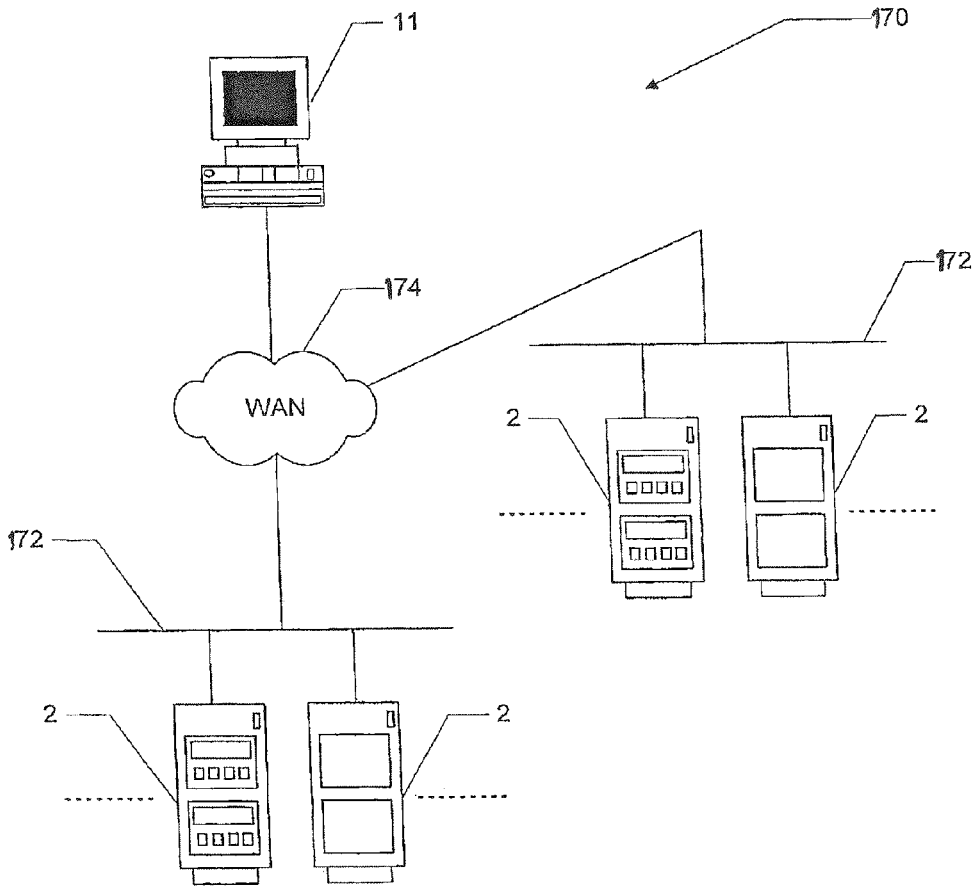
FIG. 5 is a schematic representation of a linked gaming system according to the invention.

FIG. 5 shows a schematic representation of a linked gaming system 170. The system 170 includes a plurality of gaming machines 2 linked via LANs 172. The LANs are then linked through WANs 174 allowing a single gaming server 11 to communicate with all the gaming machines 2 even though they may not be in the same physical location. This enables the gaming servers 11 to determine a second prize value based on a percentage of all the wagers on all the first game throughout the system 170.

Although the invention has been described with reference to specific embodiments, it will be appreciated by those skilled in the art that it may be embodied in other forms. In particular features of any one of the various described examples may be provided in any combination in any of the other described examples.

Furthermore, the functionality of various components have been described as being performed by distinct devices, such as dedicated integrated circuits. However, in preferred embodiments, all or any combination of their functionality is instead performed by multi-purpose integrated circuits or implemented in software executed on a microprocessor. Particularly in such cases, the invention is additionally embodied in a computer program or in a computer program in a data signal or stored on a data carrier.

The invention claimed is:

1. Gaming apparatus, comprising:

a plurality of gaming machines configured to provide respective players with a respective primary game and for providing primary game information to a gaming server, the gaming server being in communication with each of the gaming machines and responsive to the primary game information for providing a secondary game in which prizes are allocated to gaming machines selected from among the plurality of gaming machines, wherein the secondary game is configured to operate for a prize period at the end of which the prizes are allocated, and is repeated in successive prize periods, and wherein the secondary game is a keno-type game or a roulette-type game, wherein providing the secondary game includes, for each individual prize period:

the gaming server configured to allocate symbols from a predetermined set of symbols among the plurality of gaming machines, wherein the allocation of symbols is specific to a current prize period, wherein the gaming server is configured to determine to allocate one or more symbols to a particular gaming machine based on activity at that gaming machine, wherein the number of symbols allocated to each respective gaming machine during a draw period is determined in dependence upon played credit at that gaming machine passing progressive thresholds with more unique symbols being allocated to each gaming machine, up to a predetermined maximum, as a result of increasingly higher levels of the played credit;

each gaming machine being configured to respectively display its allocated one or more symbols wherein each gaming machine includes a respective screen configured to display its allocated one or more symbols;

the gaming server configured to perform a randomized selection process thereby to select a plurality of symbols from the predetermined set of symbols;

the gaming server configured to determine identity between symbols allocated to each gaming machine and symbols selected by the gaming server; and the gaming server configured to allocate the prizes among the gaming machines based on the identity between symbols allocated to each gaming machine and the symbols selected by the gaming server, such that the probability of a prize being allocated to a gaming machine in respect of a given prize period is related to the level of played credit at that gaming machine during the given prize period.

2. Gaming apparatus according to claim 1, wherein the secondary game has a plurality of prize levels, the probability of the prize levels being allocated to a gaming machine being dependent upon the activity at that machine.

3. Gaming apparatus according to claim 2, wherein for each prize level, there is a gaming activity threshold below which the probability of that prize being allocated is zero.

4. Gaming apparatus according to claim 3, wherein a higher prize level has a higher gaming activity threshold than a lower prize level.

5. Gaming apparatus according to claim 1, wherein the gaming server is configured to allocate the prizes periodically.

6. Gaming apparatus according to claim 1, wherein the gaming server is configured to allocate the prizes at a time determined by the activity at least one of the gaming machines.

7. Gaming apparatus according to claim 1, wherein for each respective gaming machine, the level of a prize to be allocated, if any, is determined in dependence upon the number of symbols allocated to that gaming machine, said symbols being selected from the predetermined set of symbols.

8. Gaming apparatus according to claim 7, wherein the symbols are allocated to the respective gaming machines randomly.

9. Gaming apparatus according to claim 7, wherein the symbols are allocated to the respective gaming machines in dependence upon selections by a player of that gaming machine.

10. Gaming apparatus according to claim 7, wherein the number of symbols allocated to each respective gaming machine is determined in dependence upon the gaming activity at that gaming machine.

11. Gaming apparatus according to claim 10, wherein higher levels of gaming at a respective gaming machine result in a larger number of symbols being allocated to the gaming machine.

12. Gaming apparatus according to claim 7, wherein prior to allocation of prizes, the gaming server selects the plurality of symbols from the predetermined set of symbols, and wherein the prizes are allocated to respective gaming machines in dependence upon the identity between symbols allocated to that gaming machine and the symbols selected by the gaming server.

13. Gaming apparatus according to claim 12, wherein the prize level allocated to a respective gaming machine depends upon the number of symbols allocated to the gaming machine which match the symbols selected by the gaming server.

14. Gaming apparatus according to claim 12, wherein the number of symbols allocated to each respective gaming machine is less than or equal to a predetermined maximum number.

15. Gaming apparatus according to claim 14, wherein the predetermined maximum number is less than the number of symbols selected by the gaming server.

16. A method of operating a gaming apparatus, comprising:

providing respective primary games at respective gaming machines which provide primary game information to a gaming server in communication with each of the gaming machines and responsive to the primary game information; and providing a secondary game in which prizes are allocated to gaming machines selected from among the plurality of gaming machines, the probability of a prize being allocated to a gaming machine being related to the level of played credit at that gaming machine during a given prize period, wherein the secondary game operates for a prize period at the end of which the prizes are allocated, and is repeated in successive prize periods, and wherein the secondary game is a keno-type game or a roulette-type game, wherein providing the secondary game includes, for each individual prize period:

allocating at the gaming server symbols from a predetermined set of symbols among the plurality of gaming machines, wherein the allocation of symbols is specific to a current prize period, wherein the gaming server determines to allocate one or more symbols to a particular gaming machine based on activity at that gaming machine, wherein the number of symbols allocated to each respective gaming machine during a draw period is determined in dependence upon played credit at that gaming machine passing progressive thresholds, with more unique symbols being allocated to each gaming machine up to a predetermined maximum, as a result of increasingly higher levels of played credit;

respectively displaying at each gaming machine its allocated one or more symbols on a respective screen;

performing a randomized selection process at the gaming server thereby to select a plurality of symbols from the predetermined set of symbols;

determining at the gaming server identity between symbols allocated to each gaming machine and symbols selected by the gaming server; and allocating at the gaming server the prizes among the gaming machines based on the identity between symbols allocated to each gaming machine and symbols selected by the gaming server;

such that the probability of a prize being allocated to a gaming machine in respect of a given prize period is related to the level of played credit at that gaming machine during the given prize period.

17. A method according claim 16, wherein the secondary game has a plurality of prize levels, the probability of a prize being allocated to a gaming machine being dependent upon the activity at that machine.

18. A method according to claim 17, wherein for each prize level, there is a gaming activity threshold below which the probability of that prize being allocated is zero.

19. A method according to claim 18, wherein a higher prize level has a higher gaming activity threshold than a lower prize level.

20. A method according to claim 16, wherein the prizes are allocated periodically.

21. A method according to claim 16, further comprising allocating the prizes at a time determined by gaming activity at at least one of the gaming machines.

22. A method according to claim 16, further comprising:

determining, for each respective gaming machine, the level of a prize to be allocated, if any, in dependence upon the number of symbols allocated to that gaming machine; and selecting the symbols from a predetermined set of symbols.

23. A method according to claim 22, wherein the symbols are allocated to the respective gaming machines randomly.

24. A method according to claim 22, wherein the symbols are allocated to the respective gaming machines in dependence upon selections by a player of that gaming machine.

25. A method according to claim 22, wherein the number of symbols allocated to each respective gaming machine is determined in dependence upon the activity at that gaming machine.

26. A method according to claim 25, wherein higher levels of gaming at a respective gaming machine result in a larger number of symbols being allocated to the gaming machine.

27. A method according to claim 22, further comprising:

prior to allocation of prizes, at the gaming server selecting the plurality of symbols from the predetermined set of symbols, and allocating the prizes to respective gaming machines in dependence upon the identity between symbols allocated to each gaming machine and the symbols selected by the gaming server.

28. A method according to claim 27, wherein the prize level allocated to a respective gaming machine depends upon the number of symbols allocated to the gaming machine which match the symbols selected by the gaming server.

29. A method according to claim 27, wherein the number of symbols allocated to each respective gaming machine is less than or equal to a predetermined maximum number.

30. A method according to claim 29, wherein the predetermined maximum number is less than the number of symbols selected by the gaming server.

31. A gaming machine for use by a player, comprising:

a first interface that is responsive to the player to initiate a first game that provides a finite chance of a first prize being awarded to the player; and a second interface that is responsive to the first game for providing gaming information to a gaming controller and for receiving a control signal from the controller to allow the player to partake in a secondary game that provides a finite chance of a secondary prize being awarded to the player, wherein the probability of the secondary prize being awarded to the player is related to the level of played credit at that gaming machine during a given prize period, and wherein the gaming information provided to the gaming controller is indicative of the level of played credit at that gaming machine;

wherein the secondary game is provided by a gaming server, wherein the secondary game operates for a prize period at the end of which prizes are allocated, and is repeated in successive prize periods, wherein the secondary game is a keno-type game or a roulette-type game, and wherein providing the secondary game includes, for each individual prize period:

the gaming server allocating symbols from a predetermined set of symbols among the plurality of gaming machines, wherein the allocation of symbols is specific to the current prize period, wherein the gaming server determines to allocate one or more symbols to a particular gaming machine based on activity at that gaming machine, and wherein the number of symbols allocated to each respective gaming machine during the draw period is determined in dependence upon played credit at the gaming machine passing progressive thresholds, with more unique symbols being allocated to each gaming machine, up to a predetermined maximum, as a result of increasingly higher levels of played credit;

each gaming machine respectively displaying its allocated one or more symbols on a respective screen;

the gaming server performing a randomized selection process thereby to select a plurality of symbols from the predetermined set of symbols;

the gaming server determining identity between symbols allocated to each gaming machine and symbols selected by the gaming server; and the gaming server allocating prizes among the gaming machines based on the identity between the symbols allocated to each gaming machine and the symbols selected by the gaming server, such that the probability of a prize being allocated to a gaming machine in respect of a given prize period is related to the level of played credit at that gaming machine during the prize period.

32. A gaming machine according to claim 31, wherein the first game has an expected duration and the secondary game has a predetermined duration and wherein the predetermined duration is greater than the expected duration.

33. A gaming machine according to claim 32, wherein the predetermined duration is greater than a sequence of consecutive first games.

34. A gaming machine according to claim 33, wherein the gaming controller includes a credit receiver for receiving credit from the player to wager on the first game.

35. A gaming machine according to claim 34, wherein at least a portion of the credit is wagered on the secondary game.

36. A gaming machine according to claim 33, wherein the first prize is selected from a pool of available prizes.

37. A gaming machine according to claim 36, wherein the first interface is responsive to the player to respectively initiate a plurality of first games each of which provides a finite chance of the first prize being awarded to the player.

38. A gaming machine according to claim 34, wherein the credit receiver includes an accumulator to provide a credit signal that is indicative of the wagers on the first games, the gaming machine being responsive to the credit signal for deriving the gaming information and the gaming controller being responsive to the gaming information for selectively providing the control signal.

39. A gaming machine according to claim 38, wherein the credit signal is indicative of the timing and quantum of the wagers.

40. A gaming machine according to claim 38, wherein the gaming machine includes a timer for defining a predetermined past period, and wherein the gaming machine is responsive to the credit signal and the predetermined past period when deriving the gaming information.

41. A gaming machine according to claim 31, wherein the gaming controller includes a prize server for determining a prize value for the secondary prize and for selectively including data indicative of the prize value in the control signal.

42. A gaming machine according to claim 41, wherein the prize server selectively includes the data in the control signal if the player has been awarded the secondary prize.

43. A gaming machine according to claim 41, wherein the prize server is responsive to the gaming information for determining the prize value.

44. A gaming machine according to claim 43, wherein the gaming information includes data indicative of the prize value.

45. A gaming machine according to claim 43, wherein the gaming machine includes a display unit that is responsive to the gaming information for displaying the prize value.

46. A gaming machine according to claim 45, wherein the display unit includes light emitting diode (LED) screen.

47. A gaming machine according to claim 45, wherein the secondary game includes:

the gaming controller allocating a set of symbols to each of the players participating in the secondary game, where the symbols in each set are a sub-set of the symbols available for allocation; and the display unit displaying to the players at predetermined intervals a selected symbol.

48. A gaming machine according to claim 47, wherein the sets of symbols are each unique for each given secondary game.

49. A gaming machine according to claim 47, wherein the second interface allows the player to select the symbols in the set.

50. A gaming machine according to claim 31, wherein a plurality of gaming machines is located in a gaming room.

51. A gaming machine according to claim 50, wherein the gaming room includes a prize display capable of communicating with the prize server for displaying the prize value of the secondary prize.

52. A method of gaming, comprising:

being responsive to a player for initiating a first game that provides a finite chance of a first prize being awarded to the player;

being responsive to the first game for providing gaming information to a gaming controller; and receiving a control signal from the gaming controller to allow the player to partake in a secondary game that provides a finite chance of a secondary prize being awarded to the player wherein the secondary game is a keno-type game or a roulette-type game, wherein the secondary game operates for a prize period at the end of which prizes are allocated, and is repeated in successive prize periods;

wherein the probability of the secondary prize being awarded to the player is related to the level of played credit at a given gaming machine during a given prize period;

wherein gaming information provided to the gaming controller is indicative of the level of played credit at that given gaming machine during the prize period, wherein the secondary game is provided by a gaming server, and wherein providing the secondary game includes, for each individual prize period:

the gaming server allocating symbols from a predetermined set of symbols among the plurality of gaming machines, wherein the allocation of symbols is specific to a current prize period, wherein the gaming server determines to allocate one or more symbols to a particular gaming machine based on activity at that gaming machine, and wherein the number of symbols allocated to each respective gaming machine during the draw period is determined in dependence upon played credit at the gaming machine passing progressive thresholds, with more unique symbols being allocated to each gaming machine, up to a predetermined maximum, as a result of increasingly higher levels of played credit;

each gaming machine respectively displaying its allocated one or more symbols on a respective screen;

the gaming server performing a randomized selection process thereby to select a plurality of symbols from the predetermined set of symbols;

the gaming server determining identity between symbols allocated to each gaming machine and symbols selected by the gaming server; and the gaming server allocating prizes among the gaming machines based on the identity between symbols allocated to each gaming machine and symbols selected by the gaming server.

53. A gaming system, comprising:

a gaming machine having a first interface that is responsive to a player to initiate a first game that provides a finite chance of a first prize being awarded to the player, and a second interface that is responsive to the first game for providing gaming information; and a gaming controller for generating a control signal that is provided to the second interface for allowing the player to partake in a secondary game that provides a finite chance of a secondary prize being awarded to the player, wherein the secondary game operates for a prize period at the end of which prizes are allocated, and is repeated in successive prize periods;

wherein the probability of the secondary prize being awarded to a player is related to the level of played credit at that gaming machine during a given prize period;

wherein the gaming information is indicative of the level of played credit at that gaming machine; and wherein the secondary game is provided by a gaming server, wherein the secondary game is a keno-type game or a roulette-type game, and wherein providing the secondary game includes, for each individual prize period:

the gaming server allocating symbols from a predetermined set of symbols among the plurality of gaming machines, wherein the allocation of symbols is specific to a current prize period, wherein the gaming server determines to allocate one or more symbols to a particular gaming machine based on activity at that gaming machine, and wherein the number of symbols allocated to each respective gaming machine during a draw period is determined in dependence upon played credit at the gaming machine passing progressive thresholds, with more unique symbols being allocated to each gaming machine, up to a predetermined maximum, as a result of higher levels of played credit;

each gaming machine respectively displaying its allocated one or more symbols on a respective screen;

the gaming server performing a randomized selection process thereby to select a plurality of symbols from the predetermined set of symbols;

the gaming server determining identity between symbols allocated to each gaming machine and symbols selected by the gaming server; and the gaming server allocating prizes among the gaming machines based on the identity between symbols allocated to each gaming machine and symbols selected by the gaming server.

54. A method for gaming, comprising:

providing a gaming machine having a first interface that is responsive to a player to initiate a first game that provides a finite chance of a first prize being awarded to the player and a second interface that is responsive to the first game for providing gaming information; and generating with a gaming controller a control signal that is provided to the second interface for allowing the player to partake in a secondary game that provides a finite chance of a secondary prize being awarded to the player, wherein the secondary game operates for a prize period at the end of which prizes are allocated, and is repeated in successive prize periods;

wherein the probability of the secondary prize being awarded to the player is related to the level of played credit at that gaming machine during a given prize period;

wherein the gaming information is indicative of the level of played credit at that gaming machine; and wherein the secondary game is provided by a gaming server wherein the secondary game is a keno-type game or a roulette-type game; and wherein providing the secondary game includes, for each individual prize period:

the gaming server allocating symbols from a predetermined set of symbols among the plurality of gaming machines, wherein the allocation of symbols is specific to a current prize period, wherein the gaming server determines to allocate one or more symbols to a particular gaming machine based on activity at that gaming machine, and wherein the number of symbols allocated to each respective gaming machine during a draw period is determined in dependence upon played credit at the gaming machine passing progressive thresholds, with more unique symbols being allocated to each gaming machine, up to a predetermined maximum, as a result of increasingly higher levels of played credit;

each gaming machine respectively displaying its allocated one or more symbols on a respective screen;

the gaming server performing a randomized selection process thereby to select a plurality of symbols from the predetermined set of symbols;

the gaming server determining identity between symbols allocated to each gaming machine and symbols selected by the gaming server; and the gaming server allocating prizes among the gaming machines based on the identity between symbols allocated to each gaming machine and symbols selected by the gaming server.

55. A gaming system, comprising:

a primary gaming machine for configured to provide a player with a first game, said primary gaming machine being connected to a communications link;

a secondary gaming machine in communication with said primary gaming machine configured to provide said player with a second secondary game, wherein the secondary game operates for a prize period at the end of which prizes are allocated, and is repeated in successive prize periods; and a link controller connected to said communications link and being in communication with said secondary gaming machine and configured to provide gaming information to said secondary gaming machine;

wherein the probability of a prize being awarded to the player in respect of the secondary game is related to the level of played credit at the primary gaming machine during a particular prize period during which the secondary game operates, and wherein the gaming information is indicative of that level of played credit at the primary gaming machine;

wherein the secondary game is a keno-type game or a roulette-type game, and wherein the secondary game includes, for each individual prize period:

the gaming server is configured to provide symbols from a predetermined set of symbols among the primary and secondary gaming machines, wherein the allocation of symbols is specific to a current prize period, wherein the gaming server is configured to determine to allocate one or more symbols to a particular gaming machine based on activity at that gaming machine, and wherein the number of symbols allocated to each respective gaming machine during a draw period is configured to be determined in dependence upon played credit at a gaming machine passing progressive thresholds, with more unique symbols being allocated to each gaming machine, up to a predetermined maximum, as a result of increasingly higher levels of played credit;

each of the primary and secondary gaming machines respectively displaying its allocated one or more symbols on a respective screen;

the gaming server performing a randomized selection process thereby to select a plurality of symbols from the predetermined set of symbols;

the gaming server determining identity between symbols allocated to each gaming machine and symbols selected by the gaming server; and the gaming server allocating prizes among the gaming machines based on the identity between symbols allocated to each gaming machine and symbols selected by the gaming server.

56. A gaming system according to claim 55, wherein the secondary game is selectively provided to the player by the link controller.

57. A gaming system according to claim 56, wherein the secondary game is selectively provided to the player based on a trigger event.

58. A gaming system according to claim 57, wherein the trigger event is a function of time.

59. A gaming system according to claim 57, wherein the trigger event is a function of an amount wagered by the player on the first game.

60. A gaming system according to claim 55, wherein the secondary game includes a plurality of playing levels.

61. A gaming system according to claim 60, wherein each playing level corresponds to a different prize.

62. A gaming system according to claim 61, wherein during the course of the secondary game, the player progresses through the plurality of gaming levels.

63. A gaming system according to claim 55, wherein the primary gaming machine includes an interface card in communication with the secondary gaming machine for enabling communication between the primary gaming machine and the secondary gaming machine.

64. A gaming system according to claim 63, wherein the interface card further enables communication between the secondary gaming machine and the link controller via the communications link.

65. A gaming system according to claim 64, wherein the communication is in a proprietary protocol.

66. A gaming system according to claim 1, wherein the secondary gaming machine includes a keypad for allowing the player to input selections during the secondary game.

67. A gaming system according to claim 66, wherein the secondary gaming machine includes a display for displaying the secondary game to the player.

68. A gaming system according to claim 67, wherein the gaming system includes a display in communication with the link controller for displaying selected gaming information.

69. A gaming system according to claim 55, wherein the link controller is programmable for providing a plurality of secondary games.

* * * * *